United States Patent [19]

Zissimopoulos

[11] 4,236,132

[45] Nov. 25, 1980

[54] ELECTROMAGNETIC SWITCH MEANS FOR A FLOW CONTROL DEVICE AND THE LIKE HAVING REDUCED SHOCK LEVELS

[75] Inventor: Nicholas Zissimopoulos, Schaumberg, Ill.

[73] Assignee: Baxter Travenol Laboratories, Inc., Deerfield, Ill.

[21] Appl. No.: 11,250

[22] Filed: Feb. 12, 1979

[51] Int. Cl.[3] ..... H01F 7/08

[52] U.S. Cl. ..... 335/271; 335/193; 335/234

[58] Field of Search ..... 335/81, 86, 90, 104, 335/105, 193, 194, 247, 248, 270, 271, 273, 276, 277, 234, 236, 229, 230, 46, 157, 257

[56] References Cited

U.S. PATENT DOCUMENTS

| | | | |
|---|---|---|---|
| 2,702,841 | 2/1955 | Bernstein | 335/270 |
| 3,184,651 | 5/1965 | Albosta | 335/273 |
| 3,501,724 | 3/1970 | Westphal | 335/248 |
| 3,693,125 | 9/1972 | Prouty | 335/277 |

*Primary Examiner*—Harold Broome

*Attorney, Agent, or Firm*—Paul C. Flattery; John P. Kirby, Jr.; Garrettson Ellis

[57] ABSTRACT

An electromagnetic switch which comprises an armature pivotally movable between first and second pivotal positions about a fulcrum positioned between its ends. Magnet means are positioned adjacent each of the armature ends and present opposite polarities outwardly from each end of the armature. Electromagnet core means define arms positioned adjacent the magnet means at each armature end, with the magnet means being each respectively movable toward and away from an arm when pivoting between the first and second pivotal positions. The armature can be moved between the first and second positions by changing the polarity of the electromagnet core means. In accordance with this invention, restraining means engagable with the armature for preventing the armature from pivoting into contact with the electromagnet core means are provided for prevention of noise and for preservation of the life of the magnet means.

7 Claims, 3 Drawing Figures

ELECTROMAGNETIC SWITCH MEANS FOR A FLOW CONTROL DEVICE AND THE LIKE HAVING REDUCED SHOCK LEVELS

BACKGROUND OF THE INVENTION

In the U.S. Pat. No. 4,121,584 of Turner, et al. a new technique for the positive control of flow of parenteral solution or the like is provided, utilizing only the gravity head pressure of the solution, coupled with excellent accuracy of delivery volume. The flow control device utilizes a pair of alternating valves which open and close, controlling the inlet and outlet to a metering chamber.

In the patent application of Nicholas Zissimopoulos Ser. No. 878,970, filed Feb. 17, 1978 an E-frame electromagnet switch is provided which gives improved characteristics of control and convenience to the previously described invention. This electromagnetic switch includes an E-frame electromagnet which controls an armature having magnets on the ends thereof. According to the polarity of the E-frame electromagnet, the armature pivots back and forth between a pair of first and second pivotal positions opening and closing the inlet and outlet valves of a flow controller device, which may be generally similar to the Turner, et al. arrangement.

In this invention, further improvements are provided in that the switching device of this invention operates very quietly to avoid disturbing the patient, for example, and at the same time the life of the magnet means used in the device is prolonged by being protected from shock. Accordingly, a substantial improvement in the design of the device of this invention is achieved.

DESCRIPTION OF THE INVENTION

In this invention, an electromagnetic switch, optionally for use with a flow controller device for parenteral solutions or the like, comprises an armature pivotally movable between first and second pivotal positions about a fulcrum positioned between its ends.

Magnet means are positioned adjacent each end of the armature, presenting opposite polarities outwardly from each end of the armature. An electromagnet core means defines arms positioned adjacent the magnet means and each armature end, with the magnet means being each respectively movable toward and away from an arm when pivoting between the first and second pivotal positions.

Accordingly, the armature can be moved between the first and second positions by changing the polarity of the electromagnet core means.

In accordance with this invention, restraining means are provided, engagable with the armature, for preventing the armature from pivoting into contact with the electromagnet core means. As a result of this, a slight gap between the magnets and armature ends and the electromagnet core means is always provided. This results in the prevention of a transmission of a shock to the permanent magnets carried by the armature, which preferably are the facing surfaces which would come into contact with the electromagnet core means, if not prevented in accordance with this invention. Also, the restraining means may engage the armature with a padded surface to reduce the noise of operation, which is of benefit to patients who are bedridden in the immediate vicinity of the device when it is in use.

Typically, and preferably, the restraining means comprises a pair of bracket means, each carried by an arm of the electromagnet core means. Each bracket is adapted to engage a side of the armature opposed to the electromagnet core means in one of the first and second pivotal positions.

Preferably, each bracket means is adjustably positionable to permit adjustment of the minimum and maximum spacings between each armature end and each arm of the electromagnet core means in the first and second positions. For example, it is generally preferable for the minimum spacings between the armature and the electromagnet core means to be from about 0.002 to 0.005 inch. This narrow spacing protects the magnets, and prevents excessive noise, while at the same time being sufficiently narrow to prevent a significant reduction in the magnetic field attraction between the electromagnet core means and the ends of the armature while being held in close proximity to the electromagnet core.

The minimum spacings between each armature and the associated arm of the electromagnet core are preferably adjusted so that the magnetic fields between each armature end and associated arm at the minimum spacings are of essentially equal strength.

Referring to the drawings.

Figure 1:
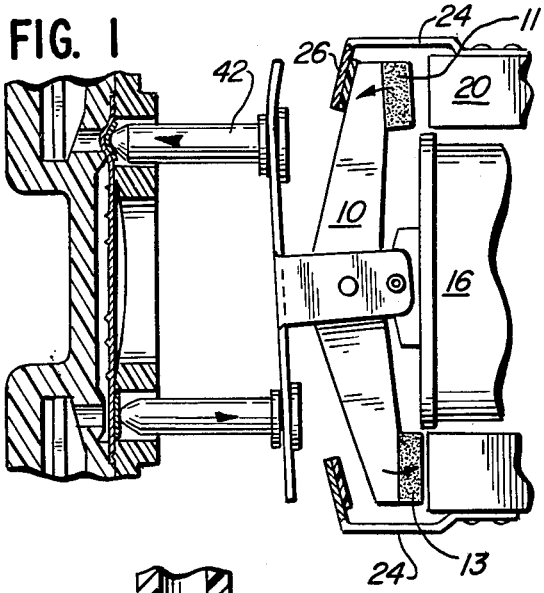
FIG. 1 is a diagramatic view of an electromagnetic switch in accordance with this invention, shown in one position of operation.
Figure 3:
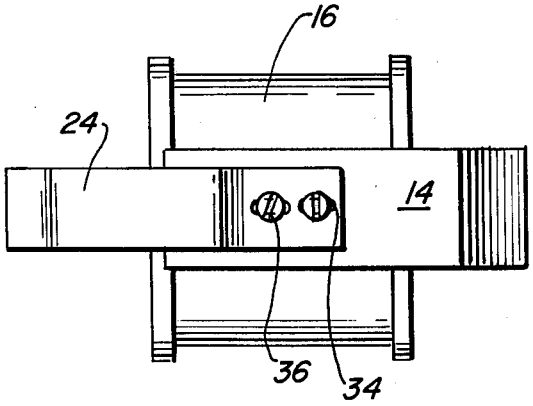
FIG. 3 is an end elevational view of the switch of FIG. 1.

Referring to the drawings, armature 10 is shown carrying permanent magnets 11 and 13, and pivotally mounted on fulcrum 12, which is defined by electromagnet core 14. Insulation material 15 is placed between core 14 and armature 10. Pin 17 is carried by armature 10, and fits loosely through a hole in core 14 for retention of armature 10.

Figure 2:
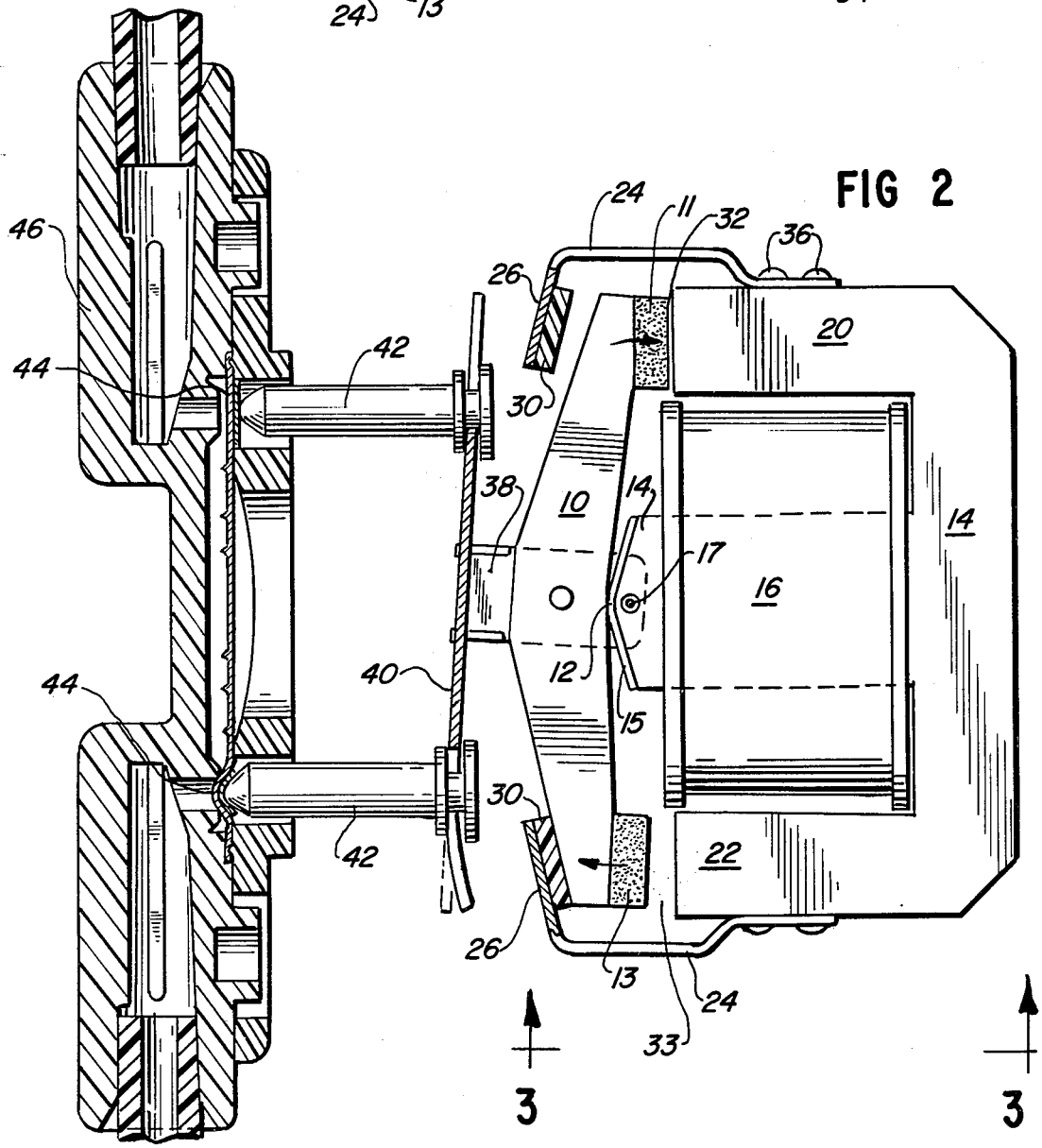
FIG. 2 is a diagramatic view of the same electromagnetic switch of FIG. 1, shown in its second pivotal position, which pivotal position depends upon the polarity of the magnet core.

Coil 16 is positioned around electromagnet core 14 so that when electricity is passed on a current through coil 16 in one direction, the polarity of core 14 is either north or south, while when the current is passed through coil 16 in the other direction, core 14 assumes the opposite magnetic polarity. As a result of the differing polarities of core 14, armature 10 will move between a first position as shown in FIG. 1, or a second pivotal position as shown in FIG. 2. This is because of the fact that magnets 11, 13, carried by armature 10, present opposite magnetic polarities outwardly, which in turn interact with either attraction or repulsion with the magnetic polarity of core 14.

For example, the outwardly-facing side of magnet 11 may be the south pole. If this is the case, then the outwardly facing surface of magnet 13 would be the north pole. Accordingly, when the entire magnet core 14 is of south polarity, the configuration will assume that shown in FIG. 1, with the electromagnet armature assuming its first pivotal position.

In accordance with this invention, restraining means are provided for preventing the ends of armature 10 from pivoting into contact with the electromagnet core means 14. The specific means shown herein are a pair of brackets 24, which are carried on legs 20 and 22 of the electromagnet core means, and are adapted to engage the side of the armature opposed the electromagnet core means by means of outer portions 26 of the brackets. Portions 26 of the brackets also carry rubber pads 30, which may preferably be about 0.02 inch to 0.03 inch thick.

Accordingly, when armature 10 is in its first or its second pivoting position, the back side of the armature is retained against a respective pad 30. Its impact against the pad 30 is, of course, soft, so that shock to the magnets 11, 13 and noise is prevented.

Brackets 24 may be adjustably attached to electromagnet core 14 by means of bolts 36, which fit through longitudinal slots 34 in each bracket member. Accordingly, the height of the bracket members 24 may be adjusted to correspondingly adjust the minimum and maximum spacings between each end of armature 10 and each arm 20, 22 of the electromagnet core means 14. Accordingly, the minimum gap 32 may be adjusted to a desired distance, preferably 0.002 to 0.005 inch, while the maximum gap 33 may be correspondingly adjusted in a manner which relates to the minimum gap distance 32.

Bolts 36 may then be tightened, to firm up the adjustment for operation.

Preferably, the respective minimum spacings between each end of armature 10 and the associated arms 20, 22 of the electromagnet core means are adjusted by means of the adjustment of bracket 24 so that the magnetic fields between each armature end and associated arm at the minimum spacings 32 are of essentially equal strength. This assures the optimum operation of the device.

Armature 10 carries a further extension member 38 and which in turn carries a leaf member 40. The plungers or valve members 42 may be placed upon leaf member 40 to operate with reinforced portions of a membrane 44 in a casette 46 for opening and closing of inlet and outlet apertures in accordance with the teachings of the above-cited Turner patent and Zissimopoulos application.

In accordance with this invention, quiet operation along with long magnet life is achieved, since the magnets are prevented from being subjected to shock during operation.

The above has been offered for illustrative purposes only, and is not intended to limit the invention of this application, which is as defined in the claims below.

That which is claimed is:

1. In an electromagnetic switch which comprises an armature pivotally movable between first and second pivotal positions about a fulcrum positioned between its ends, separate magnet means positioned at each end of said armature presenting opposite polarities outwardly from each end of the armature, and electromagnet core means, actuated by a single coil, defining arms of common polarity positioned adjacent said magnet means at each armature end, said magnet means being each respectively movable toward and away from an arm when pivoting between said first and second pivotal positions, whereby said armature can be moved between said first and second positions by changing the polarity of said electromagnet core means, and restraining means engagable with said armature for preventing the ends of said armature from pivoting into contact with said electromagnet core means, said restraining means comprising a pair of brackets, each carried by an arm of the electromagnet core means, each bracket being adapted to engage a side of said armature opposed to said electromagnet core means in one of said first and second pivotal positions.

2. The switch of claim 1 in which said restraining means engages said armature with a padded surface to reduce the noise of operation of said switch.

3. The switch of claim 2 in which each bracket is adjustably positionable to permit adjustment of the minimum and maximum spacings between each armature end and each arm of the electromagnet core means in the first and second positions.

4. The switch of claim 3 in which said minimum spacings are 0.002 to 0.005 inch.

5. The switch of claim 3 in which the minimum spacings between each armature end and the associated arm of the electromagnet core means are adjusted so that the magnetic fields between each armature end and associated arm at said minimum spacings are of essentially equal strength.

6. The switch of claim 3 in which said padded surface is defined by a rubber pad carried by said bracket means.

7. In an electromagnetic switch which comprises an armature pivotally movable between first and second pivotal positions about a fulcrum positioned between its ends, separate magnet means positioned adjacent each end of said armature presenting opposite polarities outwardly from each end of the armature, and electromagnet core means carrying a single coil and defining arms of common polarity positioned adjacent said magnet means at each armature end, said magnet means being each respectively movable toward and away from an arm when pivoting between said first and second pivotal positions, whereby said armature can be moved between the first and second positions by changing the polarity of said electromagnetic core means, restraining means engagable with said armature for preventing the ends of said armature from pivoting into contact with said electromagnet core means, said restraining means being adapted to engage said armature with a padded surface to reduce the noise of operation of said switch, said restraining means being adjustably positionable to permit adjustment of the minimum and maximum spacings between each armature end and each arm of the electromagnet core means in the first and second positions, the minimum spacings between each armature end and the associated arm of the electromagnet core means being adjusted so that the magnetic fields between each armature and associated arm at said minimum spacings are of essentially equal strength.

* * * * *